United States Patent [19]

Brastow

[11] Patent Number: 4,461,471

[45] Date of Patent: Jul. 24, 1984

[54] WALKER

[75] Inventor: Carl H. Brastow, Foxboro, Mass.

[73] Assignee: White Cap Enterprises Corporation, Hull, Mass.

[21] Appl. No.: 374,003

[22] Filed: May 3, 1982

[51] Int. Cl.[3] ..... A61H 3/04

[52] U.S. Cl. ..... 272/70.3; 135/67; 135/74

[58] Field of Search ..... 272/70.3, 70.4; 135/67; 297/5, 6; 280/28.5, 87.02 W, 87.04 R, 87.05, 647, 648, 649, 650, DIG. 3, 639, 642, 43.24, 47.2, 47.34

[56] References Cited

U.S. PATENT DOCUMENTS 3,442,276 5/1969 Edwards et al. ..... 135/67
4,056,115 11/1977 Thomas ..... 135/67
4,384,713 5/1983 Deutsch et al. ..... 280/47.34 X

FOREIGN PATENT DOCUMENTS 1103142 6/1981 Canada ..... 135/67

*Primary Examiner*—Robert A. Hafer
*Assistant Examiner*—Arnold W. Kramer
*Attorney, Agent, or Firm*—Charles E. Pfund

[57] ABSTRACT

A walker comprising spaced, parallel frame members defining spaced, parallel handrails supported by pairs of legs with wheels at the lower ends of the legs, manually-operable linkage operable to mobilize and demobilize the wheels at the lower end of at least two of the legs, characterized in that the frame members are interconnected by linkage which enables folding the frame members into overlapping parallel relation to each other.

1 Claim, 10 Drawing Figures

WALKER

BACKGROUND OF INVENTION

In pending application Ser. No. 155,292, now U.S. Pat. No. 4,384,713, filed June 2, 1980, there is shown and described a walker comprising side frames provided with handrails at the top which may be grasped to support the user and wheels at the bottom to enable rolling the walker. There is lever controlled means mounted to each side frame for braking and releasing the wheels and a transmission member extending from one side to the other which enables braking and releasing the wheels from either or both sides. In the aforesaid application, the side frames are not foldable. The purpose of this invention is to provide a foldable walker which can be folded and unfolded without having to dismantle or disconnect any of the structural and/or operative parts thereof, an undertaking which is generally not within the capacity or skill of the average patient.

SUMMARY OF INVENTION

A walker comprising spaced, parallel side frames, each side frame embodying a handrail, a rigid cross member, to the opposite ends of which the side frames are pivotally connected for folding of the side frames toward each other into overlapping positions generally parallel to the rigid cross member, a spreader bar comprising telescoping sections pivotally connected at their opposite ends to the side frames and means for locking said telescoping sections extended to hold the side frames parallel, said locking means releasable to permit folding the side frames, lever controlled means mounted to each of the side frames for braking and releasing the wheels and a transmission member positioned transversely of the side frames with its ends operably connected to the lever controlled means, operable to transmit actuation of the lever controlled means at one side to the other and vice versa, said transmission member comprising articulated parts which permit folding of the side frames without disabling the lever controlled means. The transmission member comprises articulated lengths of bar pivotally connected at their respective opposite ends to the lever controlled means, one of the lengths of transmission bar being longer than the other.

The invention will now be described in greater detail with reference to the accompanying drawings, wherein.

Figure 1:
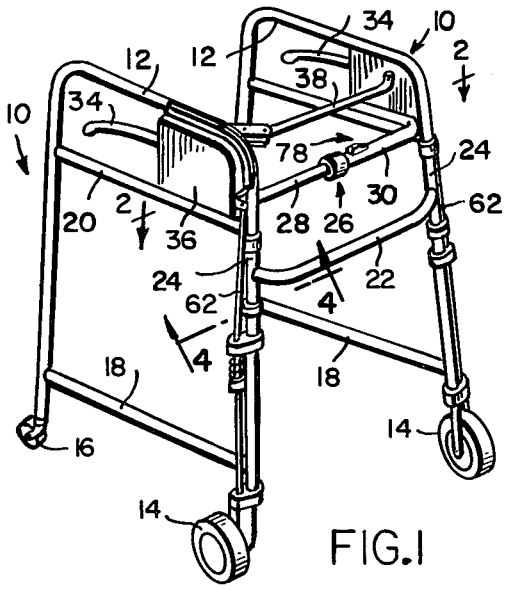
FIG. 1 is a perspective view of the walker set up for use.

Referring to the drawings, the walker comprises two side frame members 10—10 provided with the handrails 12 at the top and at the bottom, a pair of front wheels 14—14 and a pair of rear caster 16—16. Each of the frame members 10 is provided with forwardly and rearwardly-extending, rigid reinforcing bars 18—18 and 20—20 and these frames are pivotally connected to each other at a predetermined spacing at the ends of a rigid cross member 22 which has at its opposite ends vertically-positioned sleeves 24—24 for rotatably receiving portions of the side frames.

Figure 6:
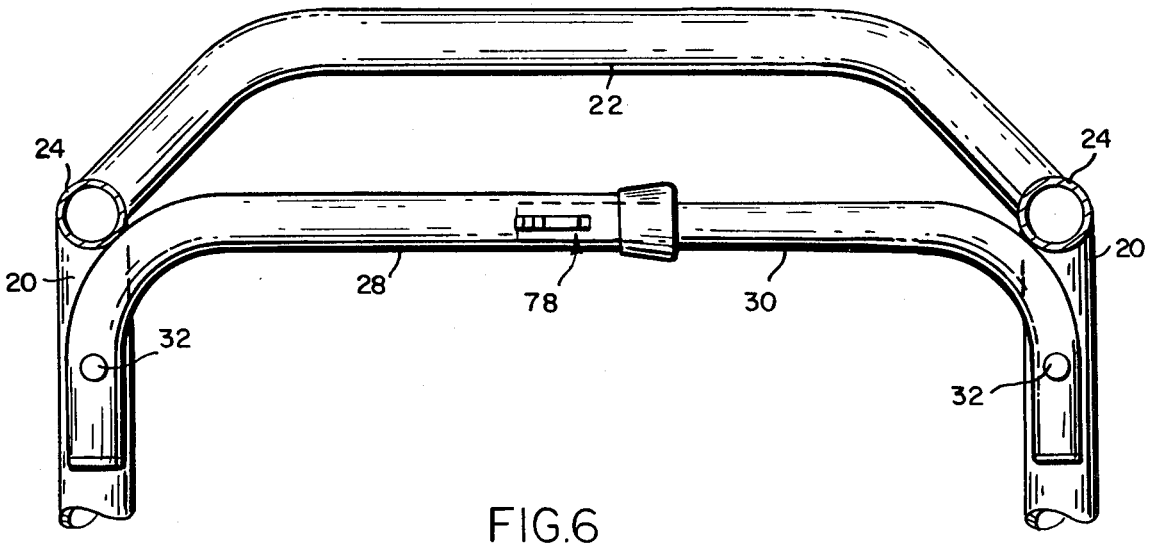
FIG. 6 is a plan view taken on the line 2—2 of FIG. 1 with the transmission removed and showing the spreader bar.
Figure 7:
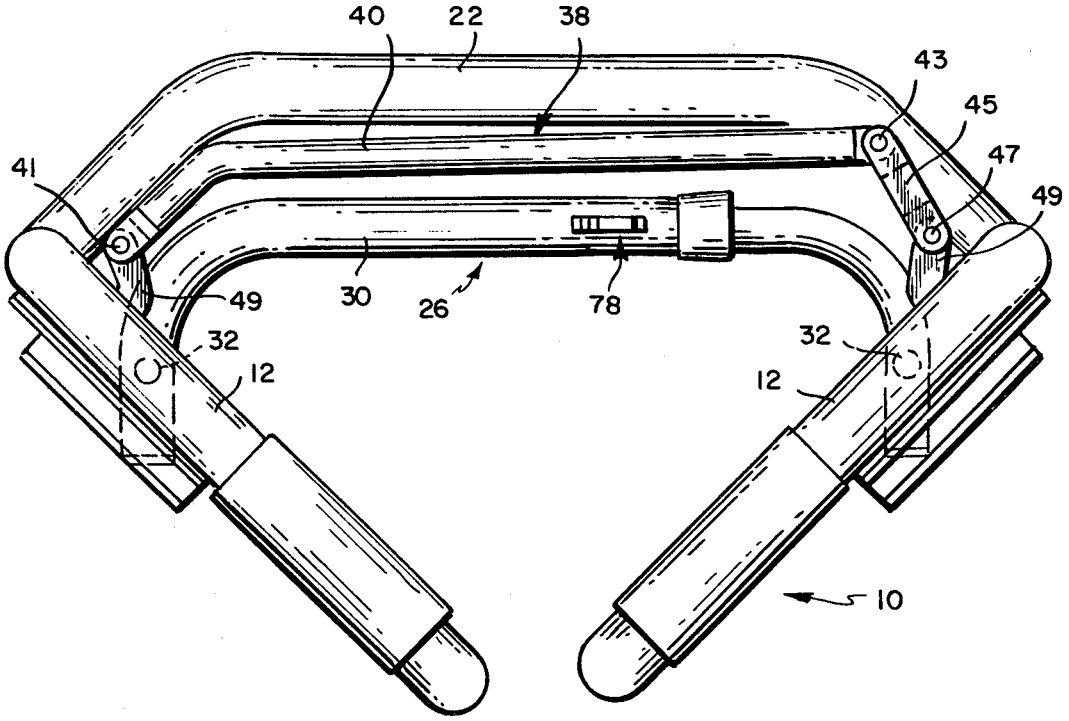
FIG. 7 is a plan view of the walker partially folded.

The side frames 10 are held in spaced, parallel relation by a spreader bar 26, FIGS. 1, 6 and 7, comprising telescoping sections 28 and 30, the distal ends of which are pivotally connected to the upper reinforcing bars 20—20 as shown in FIG. 6 on vertically-positioned pivot pins 32—32. The telescoping sections 28 and 30 are held extended by a latch 78 and, by releasing the latch, the telescoping sections can be telescoped relative to each other to permit the side frames to be folded from parallel relation to each other to an overlapping position generally parallel to the rigid cross member, as shown in FIG. 3.

Figure 5:
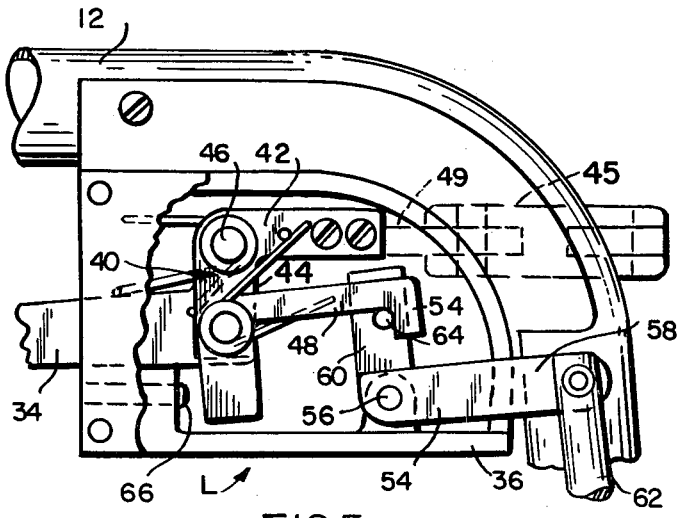
FIG. 5 is a fragmentary elevation partly broken away to show the control means at one side of the walker.
Figure 2:
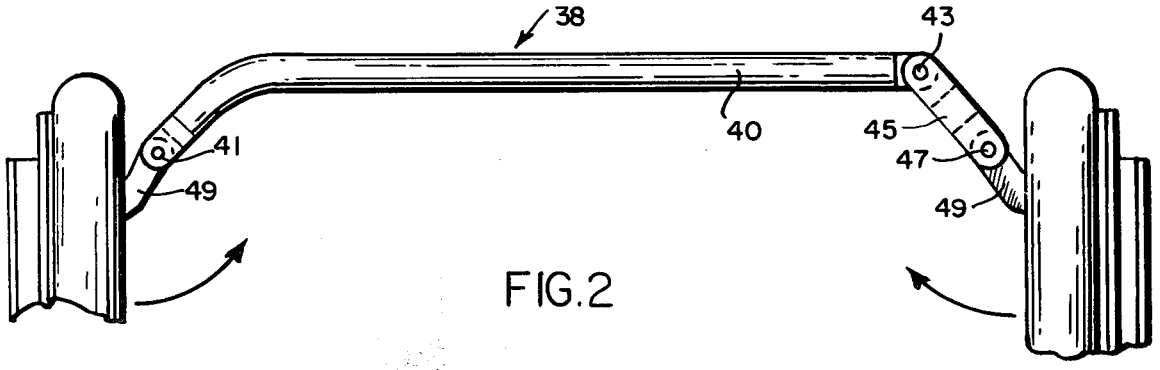
FIG. 2 is a plan view taken on the line 2—2 of FIG. 1 showing the position of the transmission member and the side frames when the latter are in spaced, parallel position.
Figure 3:
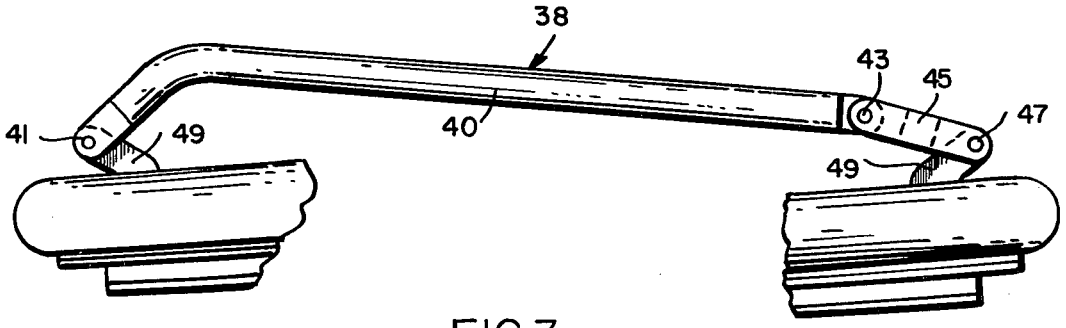
FIG. 3 is a plan view showing the transmission member when the side frames are folded toward each other.
Figure 4:
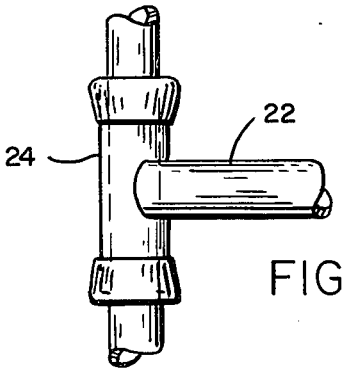
FIG. 4 is a fragmentary elevation taken on the line 4—4 of FIG. 1.
Figure 8:
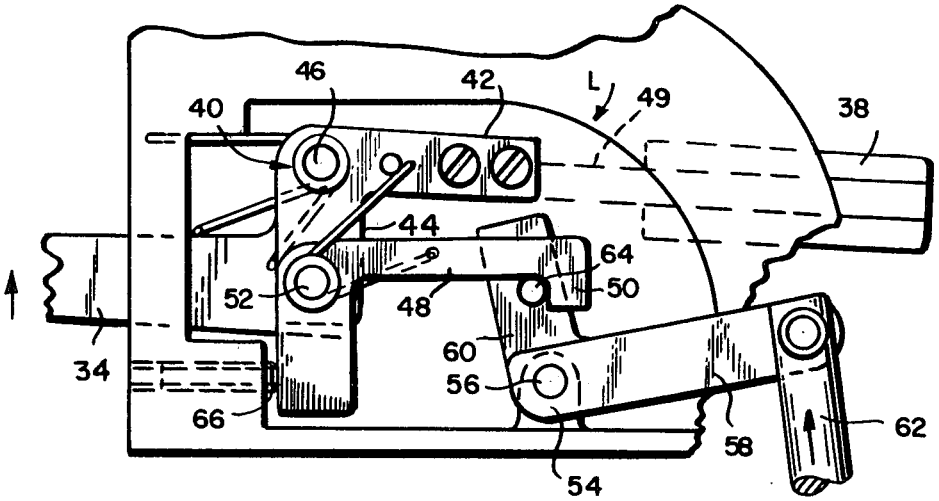
FIG. 8 is a fragmentary elevation like FIG. 5 showing the position of the control means at the stage of brake release.
Figure 9:
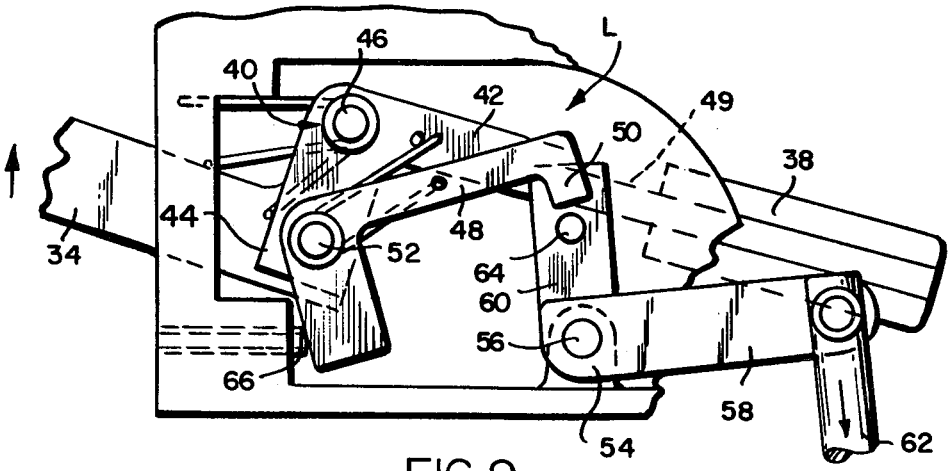
FIG. 9 is a fragmentary elevation showing the position of the control means at the stage of reapplying the brakes.

Each of the side frames 10 is provided with a hand lever 34 and with linkage L, FIGS. 5, 8 and 9, situated within a housing 36 secured to the side frame, so designed that actuation of the lever 34 at one side will apply or release the brake for the wheel at that side and, at the same time, through a transmission member 38, FIGS. 2, 3 and 7, apply or release the brake at the other side, independently of the lever at the one side and vice versa. This enables applying and releasing the brakes by actuation of either of the levers 34. The linkage L for achieving this is disclosed in FIGS. 5, 8 and 9, the same linkage being used on each side frame, wherein the lever 34, together with a first crank 40 provided with arms 42 and 44 is mounted on a fixed pin 46 so that when the lever 34 is lifted upwardly by squeezing, the crank 40 is rotated in a clockwise direction. The ends of the transmission member 36 are connected to the arms 42 of the first crank as will be described in greater detail hereinafter. A latch 48 provided with a hook 50 is pivotally mounted by means of a pin 52 to the arm 44. A second crank 54 pivotally mounted on a fixed pin 56 is provided with arms 58 and 60. The arm 58 is pivotally connected to a brake rod 62. The other arm 60 has a pin 64 engaged by the latch hook 50 which provides for applying and releasing the brake when the lever 34 is actuated. As thus structured, lifting the lever 34 as by squeezing rotates the first crank 40 in a clockwise direction, FIG. 9, and such clockwise rotation moves the arm 44 of the first crank to the left which, in turn, by means of latch 48 rotates the second crank 54 in a counterclockwise direction so as to raise the brake rod 62 and thus release the brakes. However, if the squeezing movement of the lever 34 is continued, further rearward movement of the first crank 40, FIG. 9, will bring the lower end of the latch into engagement with an abutment 66 which, in turn, will rotate the latch in a counterclockwise direction so as to disengage it from the pin 64 and allow the brake rod 62 to be drawn downwardly to reapply the brake.

In the aforesaid pending application, no provision was made for folding the side frame members for storage and/or transportation. However, it was pointed out that the brake actuating mechanism described above could be used in a foldable walker by making the transmission member in two telescoping sections which could be uncoupled to permit folding. Such structure, however, has proved to be troublesome to patients with little mechanical skill, or to those whose hands are weak or feeble, as is often the case with patients using such a device.

It is, accordingly, a purpose of this invention to provide for transmission of the control from one side to the other with a transmission member which need not be dismantled or taken apart so that the walker can be folded for storage and/or transportation without the aid of an assistant. This is achieved, as shown in FIGS. 2, 3 and 7, by providing the transmission member 38 with articulated sections comprising a relatively long section 40 pivotally connected at one end by pivot means 41 to the first crank 40 at one side of the walker by means of a horizontal extension 49 secured to the arm 42 and pivotally connected at its outer end by pivot means 43 to one end of a short section 45, the other end of which is pivotally connected by pivot means 47 to a corresponding horizontal extension 49 of the crank 40 at the other side. By so constructing the transmission bar in articulated form and pivotally connecting it at its opposite ends to the respective first cranks, the side frames when folded after releasing the latch 78 so that the telescoping portions 28, 30 can slide onto each other, will first take the form shown in FIG. 7 wherein the side frames are partially folded toward each other and then the position shown in FIG. 3 wherein they are fully folded into overlapping relation. In the execution of the folding, the bar portion 45 rotates in a counterclockwise direction from the position shown in FIG. 2 to that shown in FIG. 7 and, finally, to the position shown in FIG. 3, thus providing the extra length necessary between the pivot means 41 and 47 which are moved apart by the pivotal movement of the frames about the pivot means 32—32 toward each other.

Figure 10:
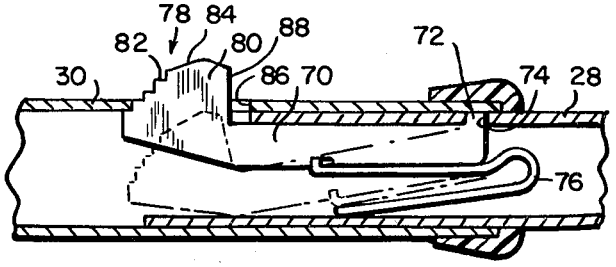
FIG. 10 is a section through a latch which holds the side frame distended.

The latch referred to above takes the form of a ratchet and spring assembly, FIG. 10, wherein an arm 70 pivoted at one end by means of a lug 72 in a hole 74 in the section 28 is yieldably supported by a spring 76 with its opposite end 80 within a slot 80 in the section 30. The end 80 has teeth 82 which, by engagement with an end of the slot 86 in the section 30, prevents the sections from telescoping toward each other, thus holding the sections distended and the side in spaced, parallel relation. By depressing the end 80 to the position shown in dotted lines, the sections 28 and 30 can be telescoped to permit folding of the sides. When the sides are opened, the latch will pop into locking position.

While the linkage of the transmission bar is comparatively simple, it constitutes a distinct advantage, as pointed out heretofore, in that it enables the patient using the walker to set it up for use or collapse it for storage or transportation without the aid of tools or assistance.

It should be understood that the present disclosure is for the purpose of illustration only and includes all modifications or improvements which fall within the scope of the appended claims.

What is claimed is:

1. A walker comprising spaced, parallel side frames, each side frame embodying a handrail and being provided with wheels for mobilization, a rigid crossbar having a straight intermediate portion throughout the major portion of its length and bent end portions, the ends of which are pivotally connected to the frame members, said crossbar defining a nest and said frame members being foldable into overlapping, generally parallel relation to each other and to the straight portion of the crossbar within the nest defined by the crossbar, a spreader bar having an intermediate portion throughout the major portion of its length comprised of straight telescoping sections and releasable locking means for holding the telescoping section distended to, in turn, hold the frame members in parallel relation, said spreader bar having end portions bent at angles such that when the spreader bar is distended, said bent end portions are parallel to the frame members, lever control means mounted to each of said frame members for braking and releasing the wheels, and a transmission member positioned transversely of the frame members with its ends operably connected to the lever control means operable to transmit actuation of the lever control means at one side to the lever control means at the other side and vice verse, said transmission member comprising articulated parts which permit folding of said frames into parallel relation without disabling the lever control means and including a rigid bar having a bent end and an articulated end wherein the bent end is pivotally connected to one of the lever control means and articulated means is pivotally connected at one end to the bar and pivotally connected at the other end to the lever control means.

* * * * *